US006722510B1

(12) United States Patent
Sen

(10) Patent No.: US 6,722,510 B1
(45) Date of Patent: Apr. 20, 2004

(54) WINE RACK

(75) Inventor: Ping-Fang Sen, TaiDong Hsien (TW)

(73) Assignee: I-Feng Kao, Tainan (TW)

( * ) Notice: Subject to any disclaimer, the term of this patent is extended or adjusted under 35 U.S.C. 154(b) by 0 days.

(21) Appl. No.: 10/341,013

(22) Filed: Jan. 13, 2003

(51) Int. Cl.[7] ..... A74B 73/00
(52) U.S. Cl. ..... 211/74; 211/13.1
(58) Field of Search ..... 211/74, 71.01, 211/13.1; D7/619, 621, 603, 701, 704; D6/465, 466

(56) References Cited

U.S. PATENT DOCUMENTS

| | | | | | |
|---|---|---|---|---|---|
| 2,267,522 | A | * | 12/1941 | Havlis | 211/74 |
| 2,278,390 | A | * | 3/1942 | Havlis | 211/74 |
| 4,715,503 | A | | 12/1987 | Johnson | |
| 6,209,735 | B1 | * | 4/2001 | Gladstone et al. | 211/74 |
| 2002/0036178 | A1 | * | 3/2002 | Tombu | 211/74 |
| 2003/0205544 | A1 | * | 11/2003 | Rhodes | 211/74 |

FOREIGN PATENT DOCUMENTS

| | | | | |
|---|---|---|---|---|
| DE | 29703285 U1 | * | 4/1997 | A47B/73/00 |
| DE | 29801206 | | 1/1998 | |
| EP | 0980656 | | 8/1999 | |
| FR | 2635663 | | 8/1988 | |
| GB | 2046822 | | 4/1980 | |
| GB | 2095985 | | 10/1981 | |
| GB | 2382021 A | * | 5/2003 | A47B/73/00 |

* cited by examiner

*Primary Examiner*—Daniel P. Stodola
*Assistant Examiner*—Erica B Harris
(74) *Attorney, Agent, or Firm*—Alan Kamrath

(57) ABSTRACT

A wine rack includes a base, a plurality of arc-shaped partitioning plates, and at least one connecting rod. The base has an arc-shaped top. Longitudinal grooves are defined in the arc-shaped top and extend along a longitudinal direction of the base that is orthogonal to the arc-shaped top. Each arc-shaped partitioning plate has a first end adjacent to the base and a second end distal to the base. The first end of each arc-shaped partitioning plate is securely engaged in one of the longitudinal grooves, with each arc-shaped partitioning plate being located in a radial direction with respect to the arc-shaped top of the base. The second end of each arc-shaped partitioning plate has at least one hole. Storage spaces are defined by the arc-shaped partitioning plates and the base for receiving wine bottles. The connecting rod extends through the hole of the second end of each arc-shaped partitioning plate.

10 Claims, 5 Drawing Sheets

WINE RACK

BACKGROUND OF THE INVENTION

1. Field of the Invention

The present invention relates to a wine rack that is an aesthetically pleasing while providing the required function of receiving wine bottles.

2. Description of the Related Art

Conventional wine racks are configured to provide a plurality of storage spaces for receiving wine bottles. Nevertheless, the storage spaces are either square or triangular when viewed from either end, which is monotonous. It is, therefore, a need in a wine rack that provides a decoration suiting the indoor decoration while providing the required function of receiving wine bottles.

SUMMARY OF THE INVENTION

An object of the present invention is to provide a wine rack that provides a decoration suiting the indoor decoration while providing the required function of receiving wine bottles.

A wine rack in accordance with the present invention comprises a base, a plurality of arc-shaped partitioning plates, and at least one connecting rod. The base has an arc-shaped top. A plurality of spaced longitudinal grooves are defined in the arc-shaped top and extend along a longitudinal direction of the base that is orthogonal to the arc-shaped top. Each arc-shaped partitioning plate has a first end adjacent to the base and a second end distal to the base. The first end of each arc-shaped partitioning plate is securely engaged in one of the longitudinal grooves, with each arc-shaped partitioning plate being located in a radial direction with respect to the arc-shaped top of the base. The second end of each arc-shaped partitioning plate has at least one hole. A plurality of storage spaces are defined by the arc-shaped partitioning plates and the base for receiving wine bottles. The connecting rod extends through the hole of the second end of each arc-shaped partitioning plate.

In an embodiment of the invention, the longitudinal grooves of the base are spaced at angular intervals, and the connecting rod is flexible. Each longitudinal groove of the base receives the first ends of two of the arc-shaped partitioning plates. Each longitudinal groove of the base has a width that is two times of a width of the first end of each arc-shaped partitioning plate. The second end of each arc-shaped partitioning plate is rectilinear, with the second ends of two of the arc-shaped partitioning plates having the first ends thereof received in two of the longitudinal grooves adjacent to each other being in intimate contact with each other. Each end of the connecting rod is threaded and extends beyond an associated one of two outermost arc-shaped partitioning plates, with a fastening member having a screw hole being threadedly engaged with the threaded end of the connecting rod. Two of the arc-shaped partitioning plates having the first ends thereof received in the same longitudinal groove of the base diverge radially outward. Each partitioning plate has identical configuration to allow easy manufacture and assembly.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
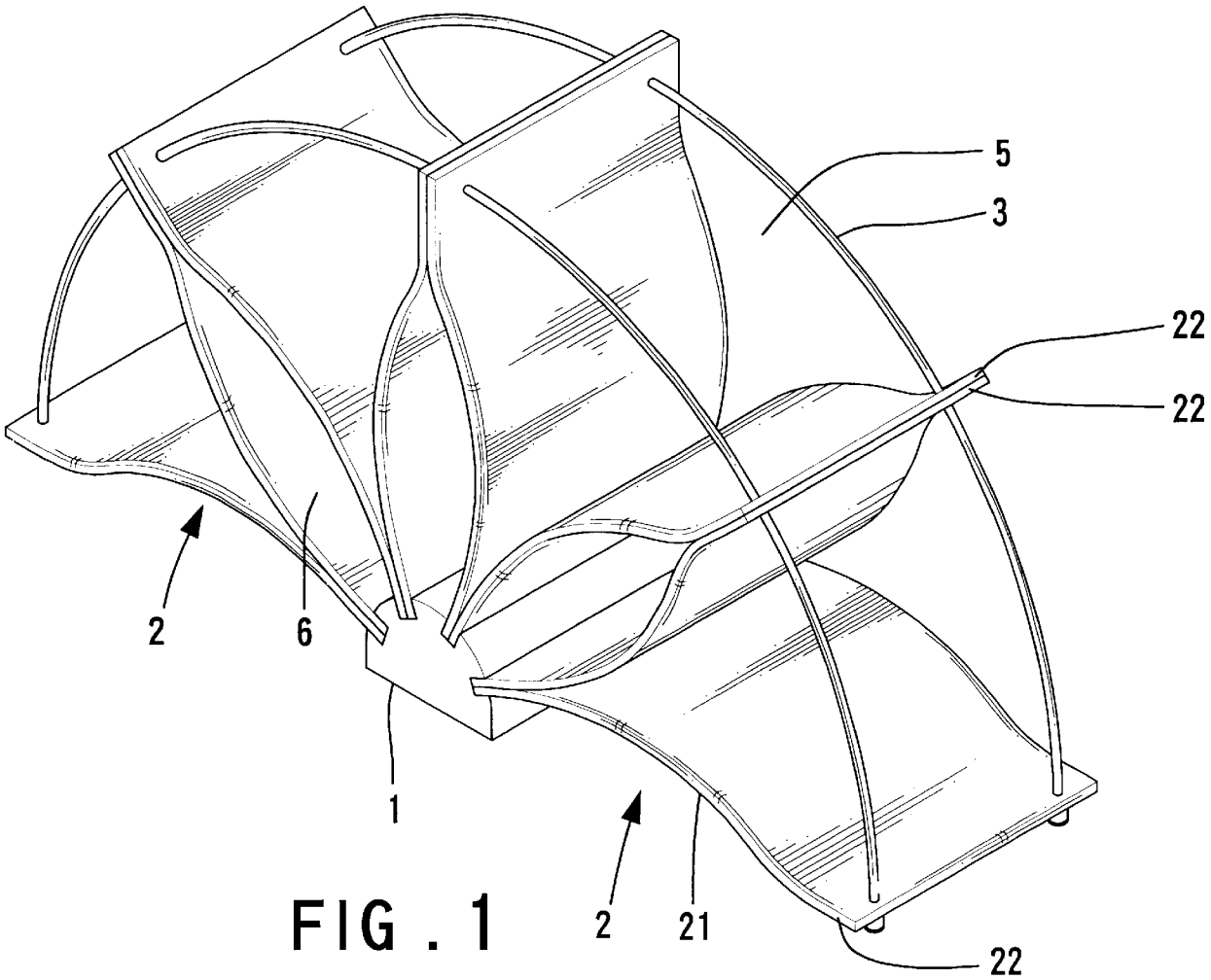
FIG. 1 is a perspective view of a wine rack in accordance with the present invention.
Figure 2:
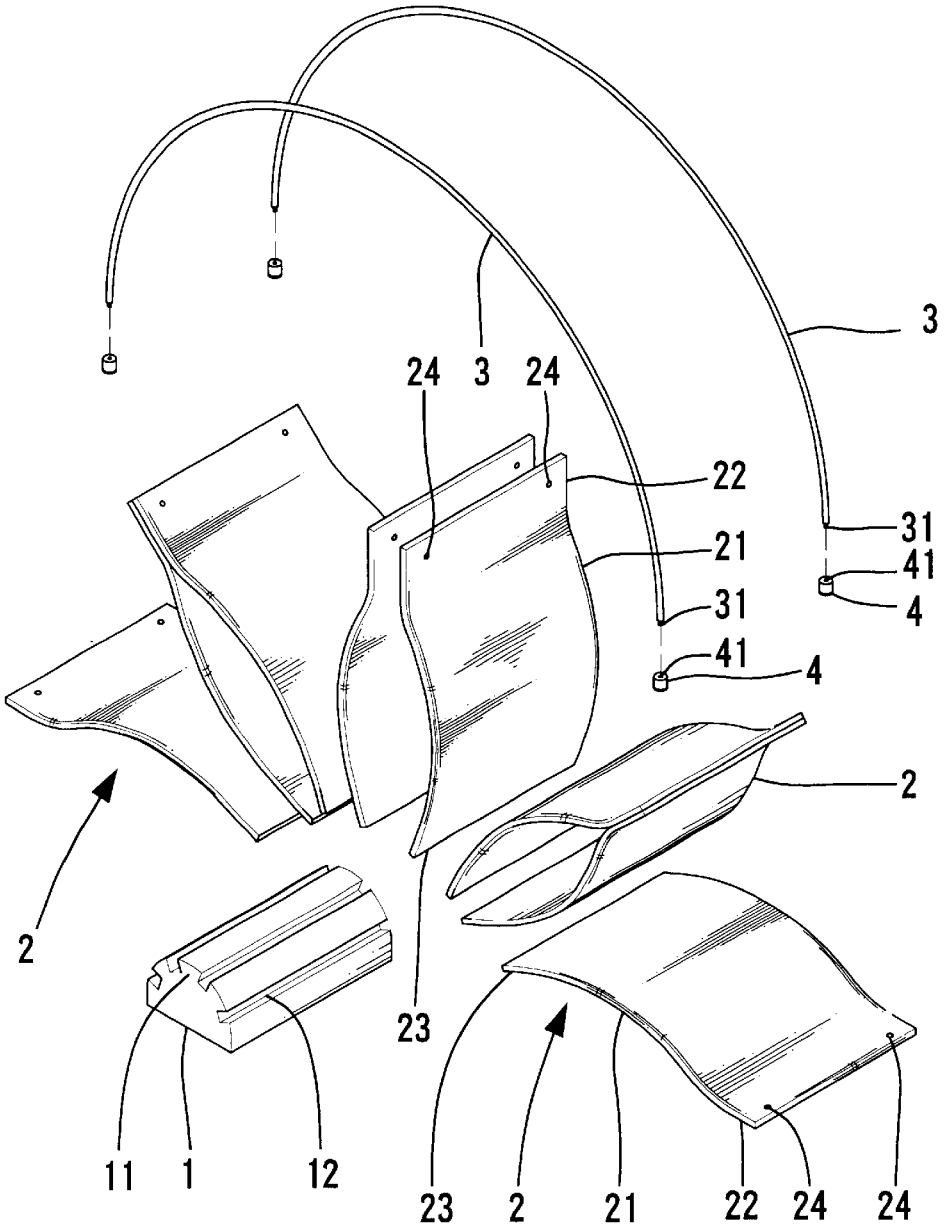
FIG. 2 is an exploded perspective view of the wine rack in accordance with the present invention.
Figure 3:
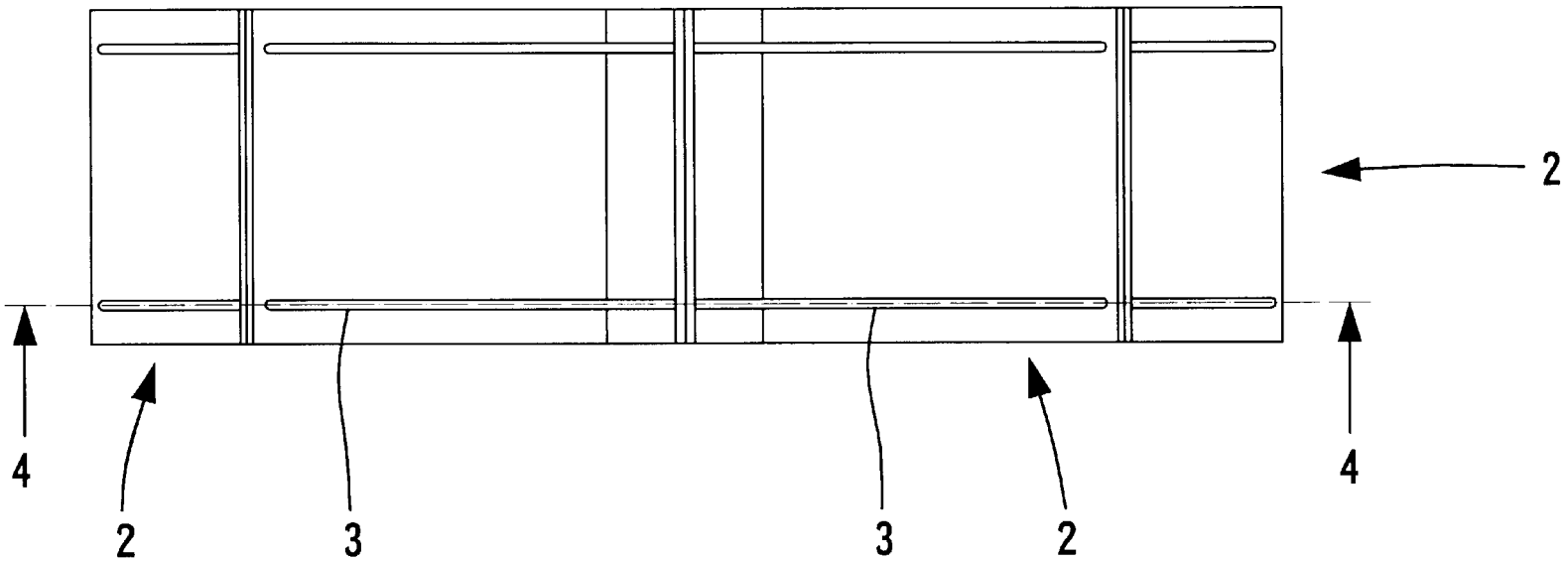
FIG. 3 is a top view of the wine rack in accordance with the present invention.

Referring to FIGS. 1 through 4, a wine rack in accordance with the present invention generally comprises a base 1, a plurality of arc-shaped partitioning plates 2, and at least one flexible connecting rod 3 (two in this embodiment).

The base 1 includes an arc-shaped top 11. A plurality of spaced longitudinal grooves 12 are defined in the arc-shaped top 11 and extend along a longitudinal direction of the base 1 that is orthogonal to the arc-shaped top 11. Preferably, the longitudinal grooves 12 of the base 1 are spaced at angular intervals.

Each arc-shaped partitioning plate 2 has a first end 23 securely engaged in one of the longitudinal grooves 12 and a second end 22 distal to the base 1. Each arc-shaped partitioning plate 2 is located in a radial direction with respect to the arc-shaped top 11 of the base 1. In this embodiment, the second end 22 of each arc-shaped partitioning plate 2 is rectilinear. Thus, each arc-shaped partitioning plate 2 has an arc-shaped section 21 adjacent to the base 1 and a rectilinear section 22 distal to the base 1. The rectilinear section 22 of each arc-shaped partitioning plate 12 has two holes 24 respectively in two ends thereof.

The connecting rods 3 extend through the holes 24 of the rectilinear section 22 of each arc-shaped partitioning plate 2. Each of two ends 31 of each connecting rod 3 is threaded and extends beyond an associated one of two outermost arc-shaped partitioning plates 2, with a fastening member 4 having a screw hole 41 (FIG. 2) being threadedly engaged with the threaded end 31 of the connecting rod 3, best shown in FIG. 4. In an alternative design, each end 31 of each connecting rod 3 has a screw hole (not shown), and each fastening member 4 has a threaded section (not shown) for threading engagement with the screw hole.

Figure 4:
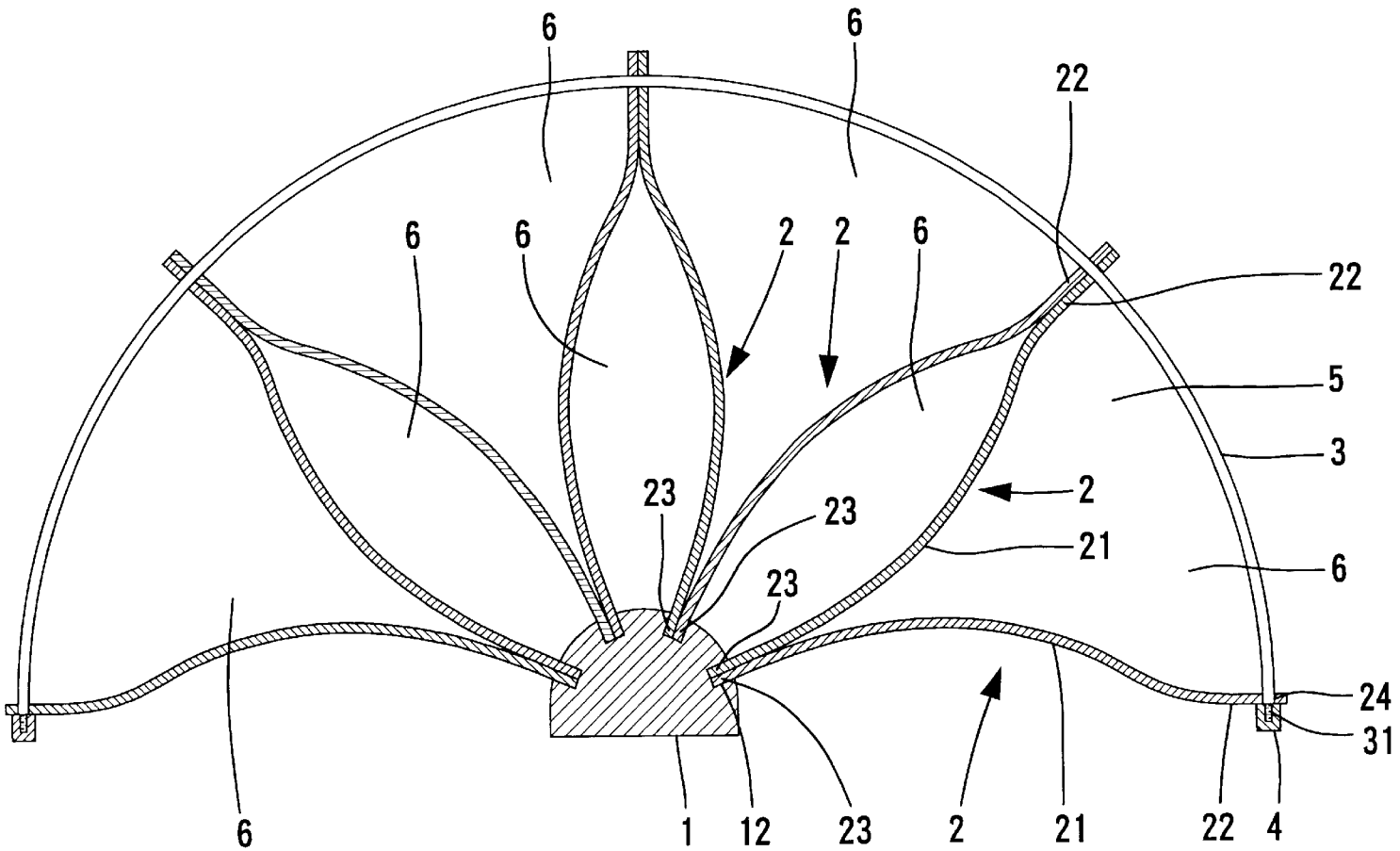
FIG. 4 is a sectional view taken along plane 4—4 in FIG. 3.

As illustrated in FIG. 4, each longitudinal groove 12 of the base 1 receives the first ends 23 of two of the arc-shaped partitioning plates 2. Preferably, each longitudinal groove 12 of the base 1 has a width that is two times of a width of the first end 23 of each arc-shaped partitioning plate 2. Thus, the first ends 23 of two arc-shaped partitioning plates 2 are tightly engaged in the respective longitudinal groove 12 of the base 1. Further, in two of the arc-shaped partitioning plates 2 whose first ends 23 are received in two of the longitudinal grooves 12 adjacent to each other, the rectilinear sections 22 of the two arc-shaped partitioning plates 2 are in intimate contact with each other. The intimately contacted rectilinear sections 22 of two adjacent arc-shaped partitioning plates 2 can be secured together by glue or any other conventional engaging means such as mortise and tenon.

The arc-shaped partitioning plates 2 are identical to one another to allow easy manufacture and assembly. The arc-shaped partitioning plates 2 are disposed in a manner shown in FIG. 4, in which each arc-shaped partitioning plate 2 is located in a radial direction with respect to the arc-shaped top 11 of the base 1. Two of the arc-shaped partitioning plates 2 whose first ends 23 are received in the same longitudinal groove 12 of the base 1 diverge radially outward (see the first partitioning plate 2 and the second partitioning plate 2, the third partitioning plate 2 and the fourth partitioning plate 2, the seventh portioning plate 2 and the eight partitioning plate 2 counting from the left). A wine glass-like or flower-like storage space 6 is provided. Further, the second partitioning plate 2 and the third partitioning plate 2 are disposed with their rectilinear sections 22 converging toward and being in contact with each other. The fourth partitioning plate 2 and the fifth partitioning plate 2 as well as the sixth partitioning plate 2 and the seventh partitioning plate 2 are disposed in the same manner, providing a storage space 6 resembling a bottle.

Figure 5:
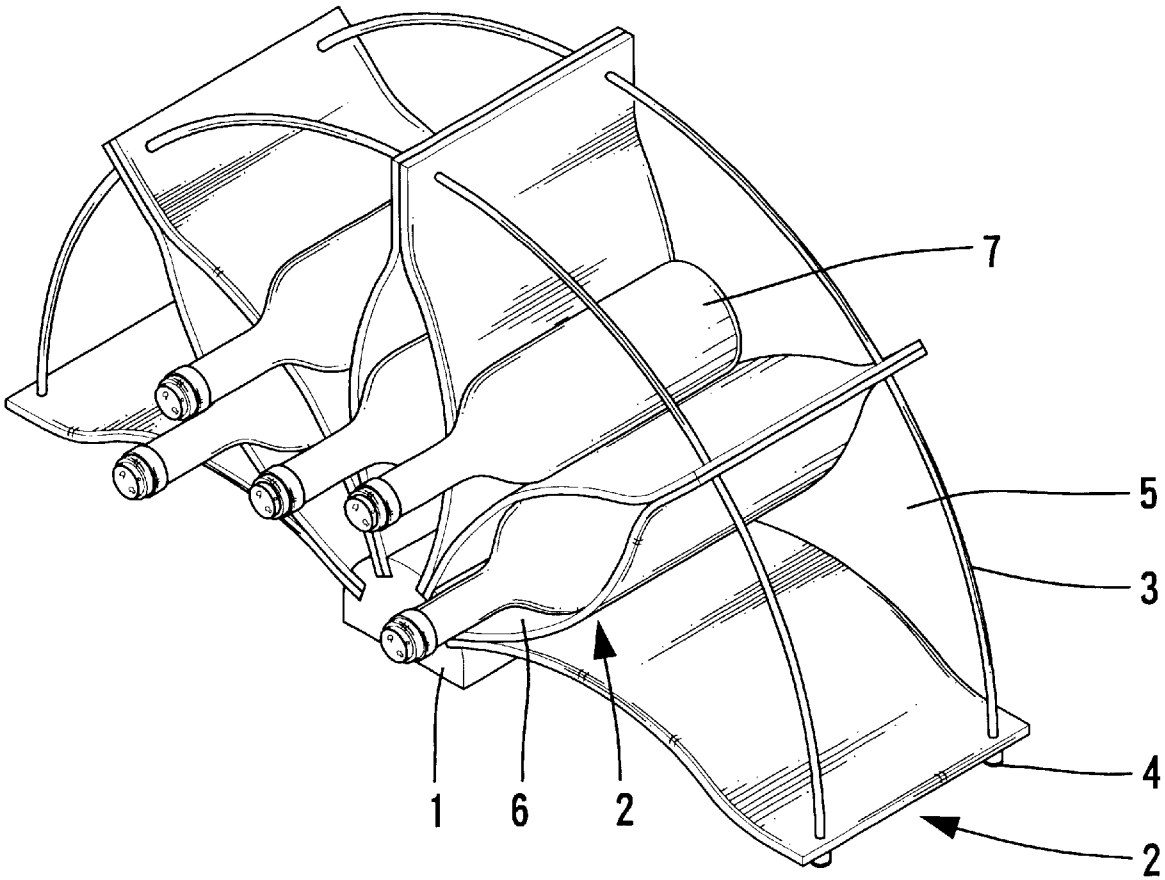
FIG. 5 is a perspective view illustrating use of the wine rack in accordance with the present invention.

As illustrated in FIGS. 4 and 5, a plurality of storage spaces 6 are defined by the arc-shaped partitioning plates 2 and the base 1 for receiving wine bottles 7. The storage spaces 6 are aesthetically pleasing while providing the required function of receiving wine bottles 7. In particular, some of the storage spaces 6 resemble a bottle, while other storage spaces 6 resemble a wine glass or a flower. Thus, the wine rack in accordance with the present invention provides a decoration suitable to the indoor decoration while providing the required function of receiving wine bottles. Further, construction of the wine rack can be easily achieved by the user, which is suitable to DIY (do it yourself).

Although the invention has been explained in relation to its preferred embodiment, it is to be understood that many other possible modifications and variations can be made without departing from the scope of the invention as hereinafter claimed.

What is claimed is:

1. A wine rack comprising:

a base including an arc-shaped top, a plurality of spaced longitudinal grooves being defined in the arc-shaped top and extending along a longitudinal direction of the base that is orthogonal to the arc-shaped top;

a plurality of arc-shaped partitioning plates, each said arc-shaped partitioning plate having a first end adjacent to the base and a second end distal to the base, the first end of each said arc-shaped partitioning plate being securely engaged in one of the longitudinal grooves, with each said arc-shaped partitioning plate being located in a radial direction with respect to the arc-shaped top of the base, the second end of each said arc-shaped partitioning plate having at least one hole, a plurality of storage spaces being defined by the arc-shaped partitioning plates and the base for receiving wine bottles; and at least one connecting rod extending through said at least one hole of the second end of each said arc-shaped partitioning plate.

2. The wine rack as claimed in claim 1, wherein the longitudinal grooves of the base are spaced at angular intervals.

3. The wine rack as claimed in claim 1, wherein each of the longitudinal grooves of the base receives the first ends of two of the arc-shaped partitioning plates.

4. The wine rack as claimed in claim 3, wherein each said longitudinal groove of the base has a width that is two times of a width of the first end of each said arc-shaped partitioning plate.

5. The wine rack as claimed in claim 3, wherein the second end of each said arc-shaped partitioning plate is rectilinear, with the second ends of two of the arc-shaped partitioning plates having the first ends thereof received in two of the longitudinal grooves adjacent to each other being in intimate contact with each other.

6. The wine rack as claimed in claim 1, wherein said at least one connecting rod is flexible.

7. The wine rack as claimed in claim 1, further comprising means for fastening two ends of said at least one connecting rod.

8. The wine rack as claimed in claim 7, wherein each of the ends of said at least one connecting rod is threaded and extends beyond an associated one of two outermost arc-shaped partitioning plates, with a fastening member having a screw hole being threadedly engaged with the threaded end of said at least one connecting rod.

9. The wine rack as claimed in claim 1, wherein two of the arc-shaped partitioning plates having the first ends thereof received in the same longitudinal groove of the base diverge radially outward.

10. The wine rack as claimed in claim 1, wherein each said partitioning plate has identical configuration.

* * * * *